US011447220B2

(12) United States Patent
Bragg

(10) Patent No.: US 11,447,220 B2
(45) Date of Patent: Sep. 20, 2022

(54) MOTOR ASSEMBLY HAVING LIFTING MECHANISM AND WATERCRAFT INCORPORATING SAME

(71) Applicant: Timothy A. Bragg, Winterport, ME (US)

(72) Inventor: Timothy A. Bragg, Winterport, ME (US)

(73) Assignee: Johnson Outdoors Inc., Racine, WI (US)

( * ) Notice: Subject to any disclaimer, the term of this patent is extended or adjusted under 35 U.S.C. 154(b) by 14 days.

(21) Appl. No.: 16/563,129

(22) Filed: Sep. 6, 2019

(65) Prior Publication Data

US 2021/0070411 A1 Mar. 11, 2021

(51) Int. Cl.

| | |
|---|---|
| ***B63H 5/125*** | (2006.01) |
| ***B63B 34/20*** | (2020.01) |
| *B63B 34/26* | (2020.01) |

(52) U.S. Cl.

CPC ..... *B63H 5/125* (2013.01); *B63B 34/20* (2020.02); *B63B 34/26* (2020.02); *B63H 2005/1254* (2013.01)

(58) Field of Classification Search

CPC ..... B63H 20/00; B63H 5/125; B63B 34/20; B63B 34/26

See application file for complete search history.

(56) References Cited

U.S. PATENT DOCUMENTS

| | | | | | |
|---|---|---|---|---|---|
| 3,245,640 | A * | 4/1966 | Ibbs | B63H 20/007 | 248/642 |
| 3,601,344 | A * | 8/1971 | Nourse | B63H 20/06 | 248/641 |
| 3,629,885 | A * | 12/1971 | Jackson | B63H 20/007 | 248/642 |
| 3,941,072 | A * | 3/1976 | Caton | B63H 25/382 | 248/642 |
| 3,948,472 | A * | 4/1976 | Metcalf | B63H 20/007 | 248/642 |
| 3,965,844 | A * | 6/1976 | Brock | B63H 20/007 | 440/62 |
| 4,410,161 | A * | 10/1983 | Booty | B63H 20/007 | 248/642 |
| 4,819,905 | A * | 4/1989 | McCain | B63H 20/007 | 114/364 |
| 5,725,401 | A * | 3/1998 | Smith | B63H 20/007 | 440/62 |
| 6,280,267 | B1 * | 8/2001 | Griffith, Sr. | B63H 20/10 | 440/6 |
| 7,195,526 | B2 * | 3/2007 | Bernloehr | B63H 20/007 | 248/642 |
| 8,337,266 | B2 * | 12/2012 | Ellis | B63H 20/00 | 440/6 |
| 9,290,251 | B1 * | 3/2016 | Schmidtke | B63H 20/02 | |
| 9,567,051 | B2 * | 2/2017 | Schmidtke | B63H 23/24 | |

(Continued)

*Primary Examiner* — S. Joseph Morano
*Assistant Examiner* — Jovon E Hayes
(74) *Attorney, Agent, or Firm* — Reinhart Boerner Van Deuren P.C.

(57) ABSTRACT

A motor assembly having a lifting mechanism and associated watercraft are provided. The lifting mechanism is operable to lift a motor of the motor assembly from a deployed position to a stowed position. A user can then transition the motor from the stowed position back to the deployed position via a user control.

19 Claims, 13 Drawing Sheets

(56) References Cited

U.S. PATENT DOCUMENTS

| | | | | |
|---|---|---|---|---|
| 9,623,944 | B2 * | 4/2017 | Kuehmichel | B63H 16/18 |
| 9,758,227 | B2 * | 9/2017 | Schmidtke | B63H 23/24 |
| 9,914,519 | B2 * | 3/2018 | Nutz | B63H 21/30 |
| 10,053,200 | B1 * | 8/2018 | Koetsier | B63H 20/106 |
| 2006/0116031 | A1 * | 6/2006 | Bernloehr | B63H 20/007 440/6 |
| 2009/0042461 | A1 * | 2/2009 | Walton | B63H 20/04 440/49 |
| 2011/0104963 | A1 * | 5/2011 | Ellis | G01C 21/203 440/6 |
| 2011/0232557 | A1 * | 9/2011 | Kilgore | B63B 1/08 114/271 |
| 2017/0001698 | A1 * | 1/2017 | Schmidtke | B63H 21/17 |

* cited by examiner

MOTOR ASSEMBLY HAVING LIFTING MECHANISM AND WATERCRAFT INCORPORATING SAME

FIELD OF THE INVENTION

This invention generally relates to watercraft technology, and more particularly to watercraft employing a motor, and even more particularly to actuation mechanisms associated with such motors.

BACKGROUND OF THE INVENTION

Recreational watercraft such as kayaks have become increasingly popular for recreational activities. Kayakers have typically used a paddle to propel the kayaks. Unfortunately, many people cannot paddle a kayak for long distances or at all due to various physical conditions. Further, currents in the water, wakes from other watercraft, etc., can make paddling a challenging process even for the fit enthusiast. Even further, if a person is using the kayak to fish, paddling becomes a limitation of the kayak as the kayaker typically must use both hands to paddle the kayak and thus cannot hold the fishing pole or operate any fishing related equipment such as deep and shallow water anchors, etc.

It has become very popular to fish from kayaks as a kayak can be maneuvered into many areas that a typical boat for fishing cannot. Due to the benefits of the maneuverability of the kayak many fisherman who would not otherwise use a kayak have become drawn to their use. Some of these fishermen would prefer a method to reduce the amount of paddling, or the amount of time, required to get to and from their fishing spot but do not want to lose the shallow water capabilities of a traditional kayak.

In view of the above, there has been a trend in recent years to utilize additional componentry on the kayak to avoid the need for paddling the kayak, or at least reduce the amount of paddling necessary. An example of such componentry is the use of motors in the context of kayaks and the like. Such motors can take on a variety of forms and provide a means for moving relatively rapidly within the water when compared to a traditional paddle arrangement. Further, such motors can alleviate the need for paddles entirely, so that the user's hands are free to fish, etc.

For example, such motors may take the form of a conventional motor normally employed on larger fishing boats. Such a motor may be mounted generally along the peripheral edge of the kayak using a mounting structure. When so mounted, the thrust provided by the lower unit of the motor may be fixed in a given direction, or a steering arrangement may also be provided to direct the thrust provided by the lower unit.

Alternatively, some kayaks may include provisions for fully integrating the motor into the kayak as opposed to the "side mount" configurations described above. In these configurations, the kayak includes a passageway into which a motor can be mounted. The lower unit of the motor typically includes a device for providing thrust that extends through the passageway and below the kayak.

While the above configurations have proven very useful integrating the advantages of a motor into the context of a kayak, there remains some drawbacks. For example, whether a side mount style or a fully integrated style, once mounted the motor is generally fixed relative to the kayak. If the user desires to enter shallow water, they may need to raise or retract the motor such that its lower unit does not strike the bottom of the body of water. Alternatively, the user may simply want to retract the motor when the thrust provided thereby is not necessary, e.g. during hauling or storage of the watercraft.

In these cases, raising or retracting the motor typically requires manually adjusting a mounted configuration of the motor. This adjustment operation in many cases implicates the user repositioning themselves such that they are in proximity to the motor to adjust it. This repositioning may be undesirable or difficult, especially if the user is currently seated in the kayak and occupied with another activity, such as holding or casting a fishing rod. Further, many contemporary motors are somewhat heavy and cumbersome, making their adjustment difficult due to these factors alone. There have been attempts to automate this adjustment operation, but such attempts typically involve relatively complex, sometimes motorized, mechanisms which drive up the overall cost, weight, and battery power consumption of the water craft.

For example, U.S. Pat. No. 8,337,266 to Ellis et al. titled "Electrically Powered Watercraft," the teachings and disclosure of which are incorporated by reference herein in their entireties, discloses the use of a motor integrated into a kayak. In order to transition the motor from its deployed position to its stowed position, a user must first manually remove a small safety pin at a hinge joint of the mechanism, which once removed, allows the motor to propel itself into a stowed position.

U.S. Pat. No. 9,290,251 to Schmidtke titled "Motor System For a Light-Weight Watercraft," the teachings and disclosure of which are incorporated by reference herein in their entireties, discloses the use of a side mounted motor associated with a kayak. The system utilizes an electric winch to raise and lower the motor, which draws power from the onboard battery.

Accordingly, there is a need in the art for a watercraft and associated motor assembly that includes a lifting mechanism that utilizes an efficient and easily manipulated mechanism for transitioning the motor from a stowed position to a deployed position. The invention provides such a watercraft and associated motor assembly. These and other advantages of the invention, as well as additional inventive features, will be apparent from the description of the invention provided herein.

BRIEF SUMMARY OF THE INVENTION

In one aspect, the invention provides a watercraft. An embodiment of such a watercraft includes a hull having a passageway and defining a cockpit area, with a motor assembly situated within said passageway. The motor assembly includes a motor and a lifting mechanism operably connected to the motor for transitioning the motor from a deployed position to a stowed position. The watercraft also includes a user control coupled to the lifting mechanism and configured to allow a user to operate said lifting mechanism from said cockpit area.

In embodiments according to this aspect, the lifting mechanism also includes a biasing member which may be embodied for example as a gas spring. The lifting mechanism includes a base arm and a lifting arm. The lifting arm has a first end and a second end. The first end of the lifting arm is pivotably connected to a first end of the base arm. The motor is connected to the lifting arm adjacent the second end of the lifting arm by a connection joint.

In embodiments according to this aspect, the connection joint may for example be a ball joint. The ball joint includes an aperture in the lifting arm and a spherical member connected to the motor, with the spherical member rotatable within the aperture.

In embodiments according to this aspect, the gas spring has a first end and a second end. The first end of the gas spring is connected to the lifting arm. The second end of the gas spring is connected to the base arm such that elongation of the gas spring causes the lifting arm to rotate about a pivot axis defined by the base arm.

In embodiments according to this aspect, the lifting mechanism also includes a docking assembly configured to mount to the hull adjacent the passageway. The docking assembly can include a docking plate, a locking bracket, and a biasing element. The locking bracket pivotably coupled to the docking plate, the locking bracket having a locked position and an unlocked position, wherein the biasing element biases the locking bracket to the locked position. In the locked position, a pin mounted at the first end of the base arm and defining a pivot axis of the lifting arm relative to the base arm is situated within a slot formed in the locking bracket.

In embodiments according to this aspect, the user control includes a cable having a first end connected to the second end of the lifting arm and a second end with a handle attached to the second end of the cable. The user control also includes a locking mechanism for locking the cable in tension such that it applies an opposing force to oppose the biasing force to hold the motor in the deployed position. The locking mechanism may, for example, be a cable cleat. The second end of the cable with the handle may be situated adjacent a cockpit area of the hull.

In another aspect, the invention provides a motor assembly for a watercraft. An embodiment of such a motor assembly includes a motor. The motor includes a shaft having a first end and a second end, a head unit mounted at the first end, and a lower unit mounted at the second end. The lower unit includes a motor and a device for providing thrust. The motor assembly also includes a lifting mechanism operably connected to the motor for transitioning the motor from a deployed position to a stowed position. The lifting mechanism includes a docking assembly configured for mounting to a watercraft, a base arm removably received within the docking assembly, and a lifting arm having a first end and a second end.

The first end of the lifting arm is pivotably connected to a first end of the base arm such that in a first angular position of the lifting arm relative to the base arm the motor is in the deployed position and such that in a second angular position of the lifting arm relative to the base arm, the motor is in the stowed position. An angle between the lifting arm and the base arm in the first angular position is less than an angle of the lifting arm relative to the base arm in the second angular position. The lifting mechanism also includes a biasing member connected between the lifting arm and the base arm for biasing the motor to the stowed position.

In embodiments according to this aspect, the docking assembly includes a docking plate, a locking bracket, and a biasing element. The locking bracket is pivotably coupled to the docking plate. The locking bracket has a locked position and an unlocked position. The biasing element biases the locking bracket to the locked position. In the locked position, a pin mounted at the first end of the base arm and defining a pivot axis of the lifting arm relative to the base arm is situated within a slot formed in the locking bracket.

In yet another aspect, the invention provides a lifting mechanism for a motor that is configured for transitioning the motor from a deployed position to a stowed position. The motor has a shaft having a first end and a second end, a head unit mounted at the first end, and a lower unit mounted at the second end. The lower unit includes a motor and a device for providing thrust. The lifting mechanism includes a docking assembly configured for mounting to a watercraft, a base arm removably received within the locking bracket, and a lifting arm having a first end and a second end. The first end of the lifting arm is pivotably connected to a first end of the base arm. A second end of the lifting arm is configured for connecting to a motor via a connection joint. The first end of the lifting arm and the first end of the base arm are commonly connected at a pin defining a pivot axis of the lifting arm relative to the base arm. A biasing member is connected between the lifting arm and the base arm for biasing the motor to the stowed position. The docking assembly is configured to receive the base arm and lock the base arm into a cradle defined by the docking assembly as the base arm is rotated about a mounting axis defined by the docking assembly.

In embodiments according to this aspect, the docking assembly includes a docking plate, a locking bracket, and a biasing element. The locking bracket is pivotably coupled to the docking plate. The locking bracket has a locked position and an unlocked position. The biasing element biases the locking bracket to the locked position such that the pin is constrained within a slot formed in the locking bracket. The locking bracket includes at least one strike plate arranged such that the pin contacts the strike plate when rotating the base arm about the mounting axis and biases the locking bracket to the unlocked position. The pin biases the locking plate to the unlocked position such that the pin rests upon the docking plate. The biasing element may, for example, be a leaf spring.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, the same illustrate embodiments of a watercraft and its associated motor assembly. The motor assembly includes a lifting mechanism that allows a user to easily and rapidly stow and deploy a motor of the motor assembly while remaining in a cockpit area of the watercraft. It is contemplated by the disclosure herein that the motor assembly may be supplied as a stand-alone device which may be retrofit into an existing watercraft, or be supplied with a watercraft as a combined system.

As will be explained in greater detail below, the motor has a deployed position and a stowed position. In the deployed position, the motor is in an orientation such that it may provide thrust to the watercraft to propel it along the water. In the stowed position, the motor is in an orientation wherein it does not protrude from a bottom of the watercraft. Advantageously, this stowed position also allows for access to a lower unit of the motor assembly so that a user can clear weeds or other debris from the lower unit. This stowed position is ideal for shallow water operations, as the motor is positioned such that it will not strike a bottom of a body of water. The aforementioned functionality is achieved in part due to a compact and ergonomically designed lifting mechanism. The lifting mechanism itself utilizes a relatively small number of components thereby reducing its overall cost, complexity, and weight.

Figure 1:
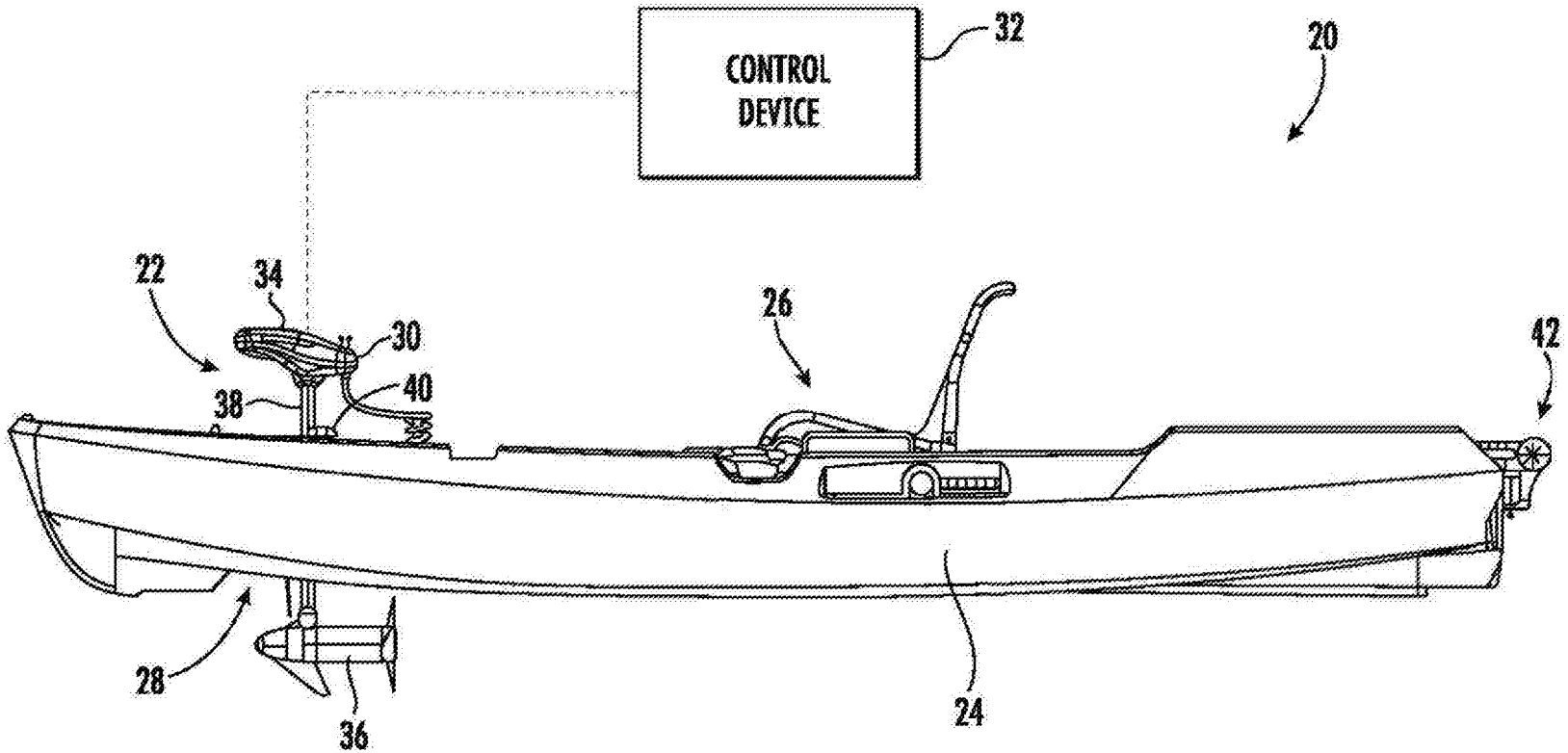
FIG. 1 is a side view of an exemplary embodiment of a watercraft and associated motor assembly according to the teachings herein.

Turning now to FIG. 1, the same illustrates an exemplary embodiment of a watercraft 20 that incorporates a motor assembly 22. Motor assembly 22 includes a motor 30, as well as a lifting mechanism 48 (FIG. 2) for transitioning motor 30 from its deployed position to its stowed position, and vice versa. In the illustrated embodiment, watercraft 20 is depicted as a kayak. However, watercraft 20 may, for non-limiting example, be a kayak, canoe, or any other vessel where it may be desirable to include a motor. Watercraft 20 includes a hull 24 with a cockpit area 26. Motor assembly 22 extends through a passageway 28 in hull 24 so that it may provide thrust to watercraft 20. Passageway 28 extends from an exterior of hull to an interior of hull 24 as shown. In other watercraft styles, e.g. a canoe, the passageway may be longer, i.e. the body defining the length of the passageway may be longer, to position the system at a desirable height relative to a user. Alternatively, passageway 28 may be a cavity in hull 24, within which a lower unit 36 of a motor 30 of motor assembly 22 transitions in and out of, with a shaft 38 of motor 30 extending through a small opening of this cavity to situate lower unit 36 therein.

Motor assembly 22, and more particularly a motor 30 thereof, may communicate with a control device 32. Control device 32 may for example be a remote control device. As another example, control device 32 may be an external component such as a fish finder or multi-function display, mobile device, a foot pedal device or other remote control, etc. In any case, control device 32 is operable to send control signals to motor 30 to control its function.

Motor 30 may include its own internal control system as well, which may include GPS technology, allowing motor 30 to determine its position, and hence the position of watercraft 20, and automatically propel watercraft 20 along a selected route. For non-limiting example, motor 30 may include i-Pilot® or i-Pilot® Link™ by Johnson Outdoors Inc., which allows for a variety of navigational functionality using a motor. Indeed, the internal control system of motor 30 may be operable to cause watercraft 20 to automatically follow a given route, follow a depth contour, or hold a particular position. Alternatively, the aforementioned functionality of the internal control system of motor 30 may be integrated additionally and/or instead within control device 32, and as such, all of the information and commands necessary to achieve the foregoing functionality may be communicated to motor 30 from control device 32.

Motor 30 includes a head unit 34 which may house the aforementioned internal control system, GPS hardware, firmware, and software, and any other componentry for controlling the operation of motor 30. Motor 30 also includes a lower unit 36 which houses a motor connected to a device for providing the aforementioned thrust. In the illustrated embodiment, this device is a propeller. However, in other embodiments, the device for providing thrust may be any device utilized in watercraft systems for providing thrust, e.g. fins, a shrouded propeller, a waterjet device, etc. A shaft 38 extends between head unit 34 and lower unit 36 and may be used for routing wiring to lower unit 36 from the remainder of motor 30.

Motor 30 also includes a steering unit 40, which is mechanically coupled to shaft 38 such that it can rotate shaft 38, and hence head unit 34 and lower unit 36, about the longitudinal axis of shaft 38. This allows for the direction of thrust from lower unit 36 for purposes of steering watercraft 20. Steering unit 40 may, for example, receive steering commands from head unit 34 and/or from control device 32 via a wired or wireless connection. Steering unit 40 includes an internal motor and any necessary mechanical components necessary to transfer input torque from this motor to shaft 38. The aforementioned steering commands allow for the automatic operation of motor 30 to achieve the various navigational functionality described herein.

Watercraft 20 may also includes a rudder system 42 (shown in its folded configuration in FIG. 1) to allow for additional steering functionality. This rudder system 42 may, for example, be operated by foot pedals or a hand control near cockpit area 26. Further, rudder system 42 could be controlled via a servo motor or other similar device, with this motor or other similar device receiving control signals from a controller. This rudder system may be utilized in combination with motor assembly 22, or alternatively, may be used when a user is manually operating watercraft via paddling. Although illustrated as a folded rudder, it is also contemplated that rudder system 42 could be integrated into hull 24 such that it does not fold as shown.

Figure 2:
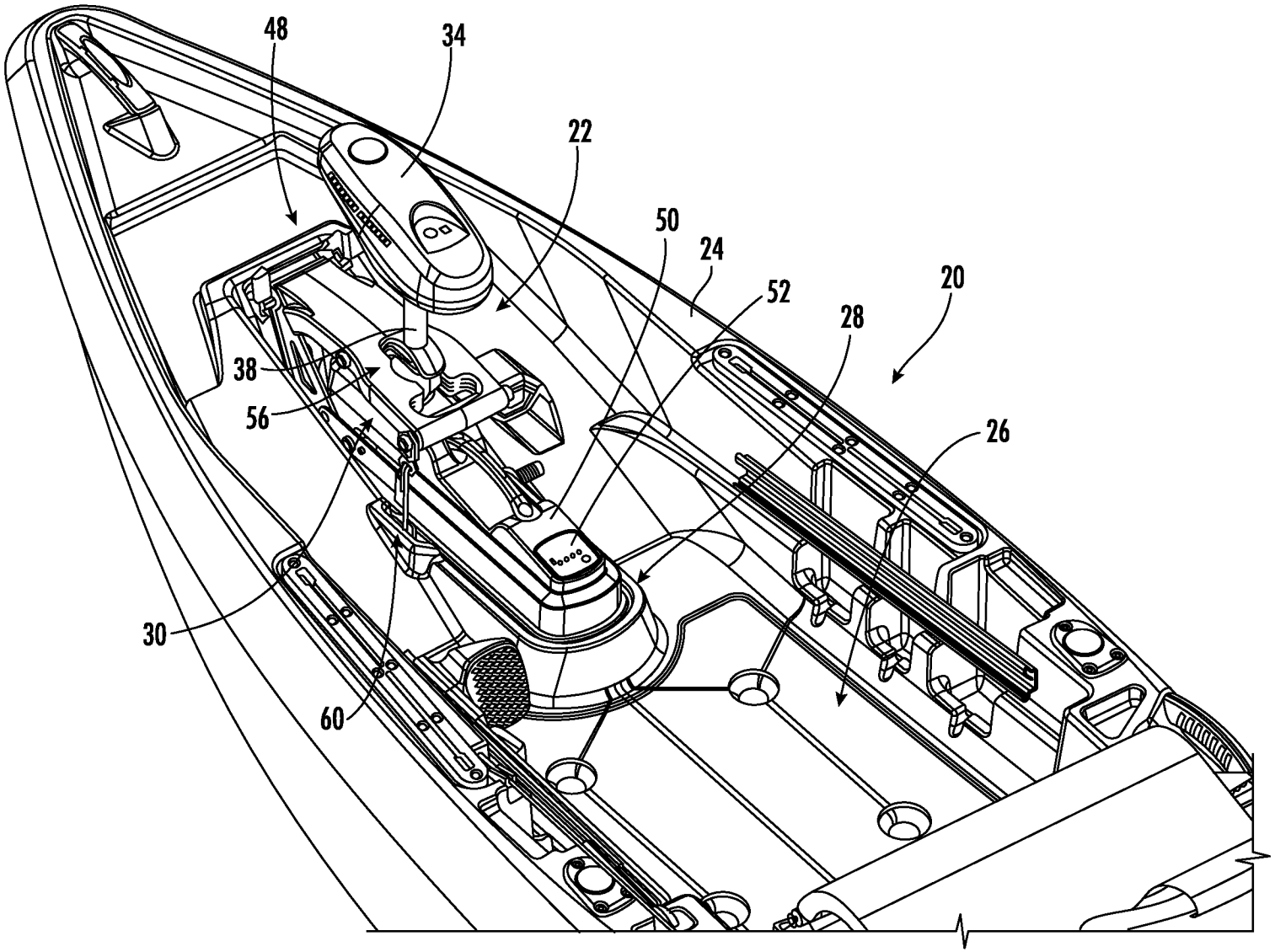
FIG. 2 is a partial perspective view of the embodiment of FIG. 1, showing a motor of the motor assembly in a deployed position.

Turning now to FIG. 2, the same illustrates a partial perspective view of watercraft 20 with motor assembly 22, and more particularly motor 30, in the deployed position. In this configuration, a lifting mechanism 48 of motor assembly 22 is in a retracted configuration, thereby allowing lower unit 36 to depend downwardly through passageway 28 as is shown in FIG. 1.

A console 50 of motor 30 which may house additional electronics for controlling the operation of motor 30 as needed and also provide a local user interface 52 mounts adjacent to passageway 28 through hull 24 such that passageway 28 is sealed off from the interior of watercraft 20, e.g. cockpit area 26, to thereby reduce or eliminate ingress of water through passageway 28. Appropriate seals may also be incorporated on console 50, the remainder of motor 30, and/or on passageway 28 so as to facilitate the foregoing.

A user control 60 of watercraft 20 is configured to operate lifting mechanism 48. As explained in greater detail below, user control 60 is configured to oppose a biasing force of a biasing member 62 (FIG. 3) of lifting mechanism 48. In the illustrated embodiment, user control 60 is embodied as a cable arrangement, with one end connected to lifting mechanism 48, and the other end routed such that it is accessible by a user while seated in cockpit area 26. A tension in this cable arrangement opposes the aforementioned biasing force of the biasing member of lifting mechanism 48 described below, and thereby holds motor 30 in the deployed position as is illustrated in FIG. 2.

Figure 3:
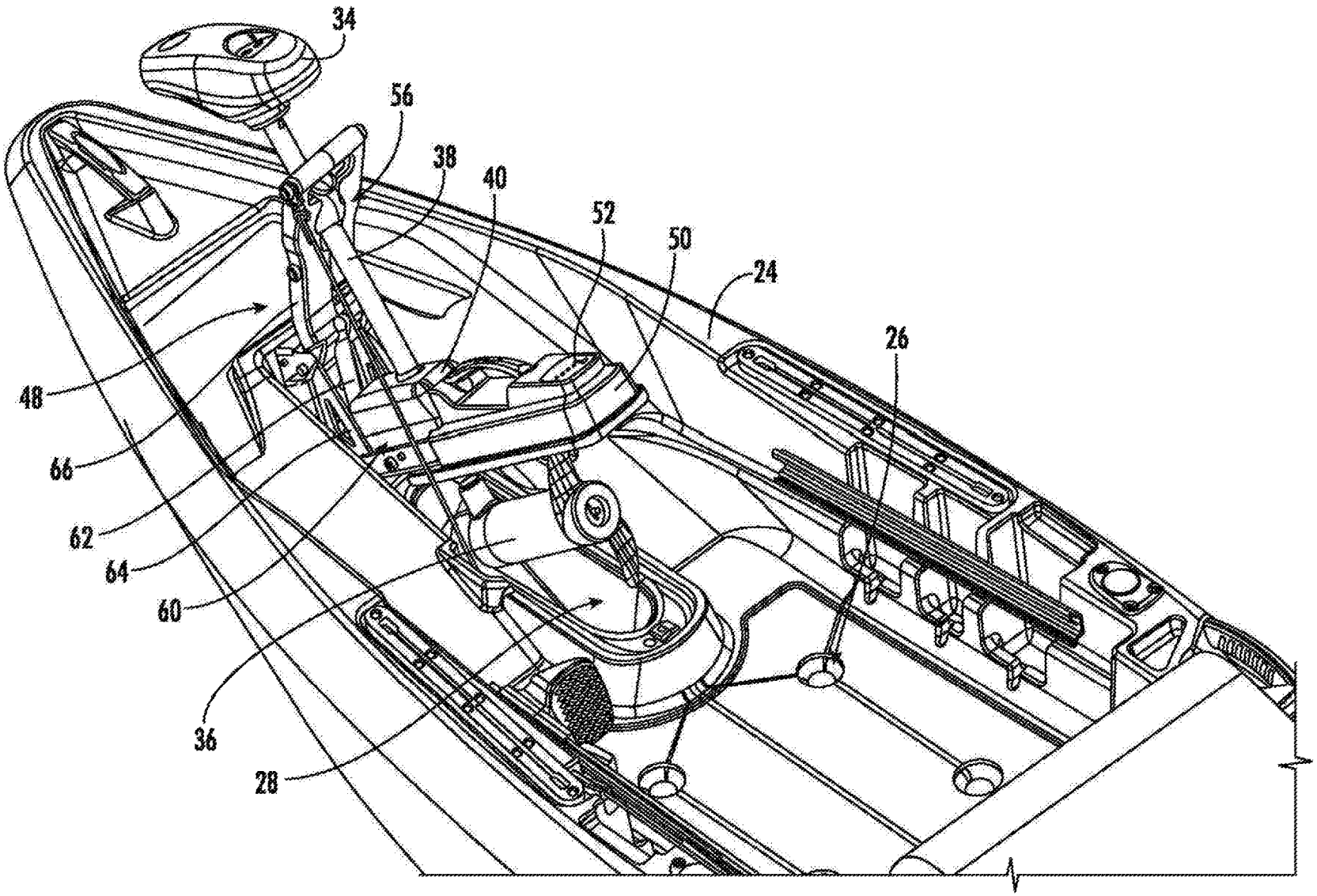
FIG. 3 is another partial perspective view of the embodiment of FIG. 1, showing the motor in a stowed position.

Turning now to FIG. 3, the same illustrates motor 30 in a stowed position such that its lower unit 36 no longer extends below hull 24 as is shown in FIG. 1. Motor 30 has been tilted within passageway 28 as is shown to achieve this configuration. More specifically, the above-introduced biasing member 62 is connected between a base arm 64 and a lifting arm 66 of lifting mechanism 48. When the tension from user control 60 is relieved such that no opposing force is present to oppose the biasing force of biasing member 62 (other than that created by the weight of the mechanism and motor 30, biasing member 62 will elongate such that lifting arm 66 rotates relative to base arm 64. Motor 30 is connected to lifting arm 66 via a connection joint 56 and is connected to base arm 64 at a pivot point such that it may tilt to the position illustrated.

To transition motor 30 back to its deployed position, a user simply pulls on user control 60 such that a tension is created therein. The user then locks user control 60 in place such that the tension remains therein, and the biasing force generated by biasing member 62 is opposed.

Figure 4:
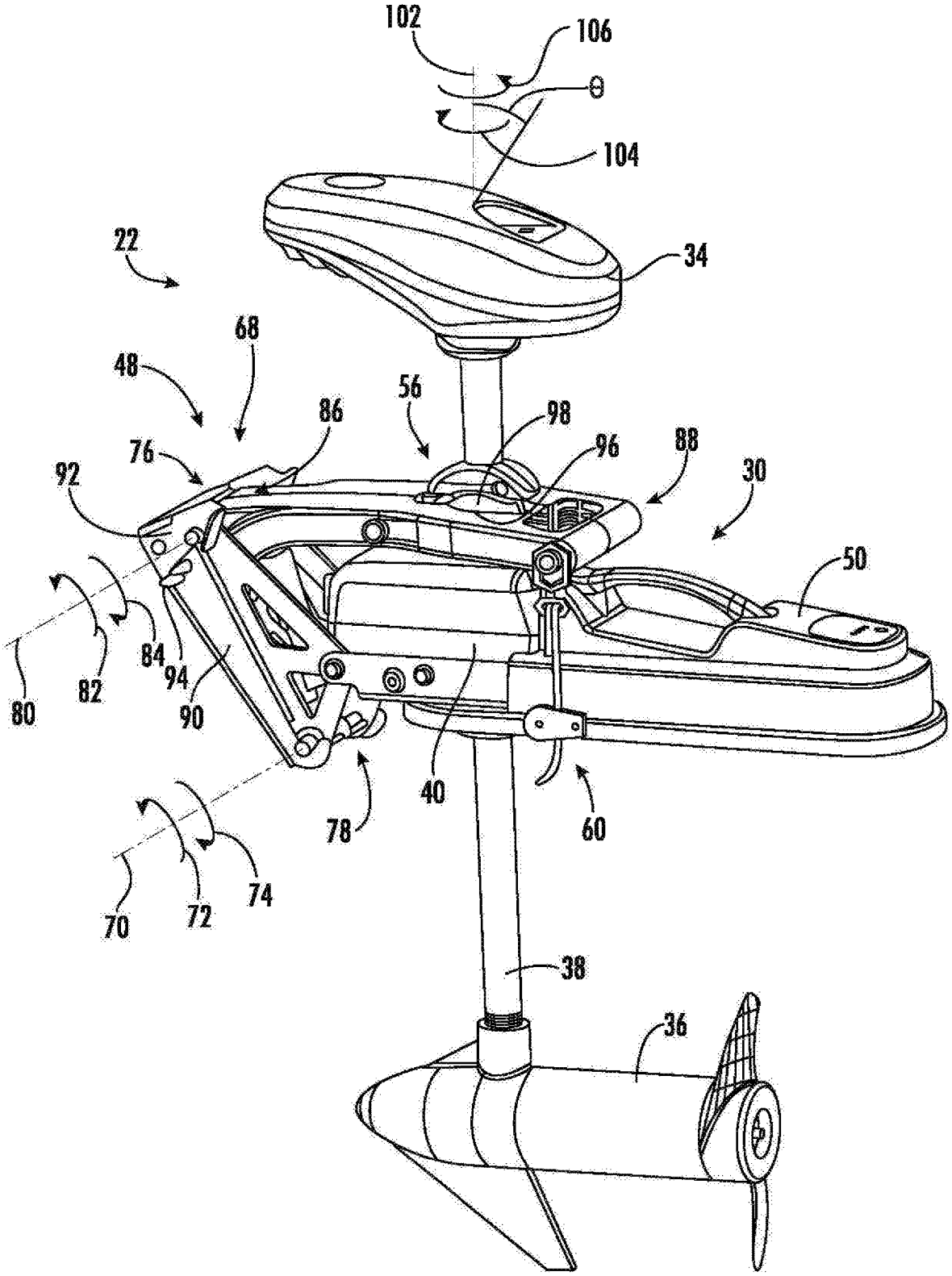
FIG. 4 is a perspective view of the motor assembly of the embodiment of FIG. 1.

Turning now to FIG. 4, the same illustrates motor assembly 22 removed from watercraft 20. Base arm 64 has a first end 76 and a second end 78. Motor 30 is pivotably connected to base arm 64 near its second end 78 as shown. Motor is pivotable at this point of connection about a pivot axis 70 in rotational directions 72, 74 relative to base arm 64. Lifting arm 66 has a first end 86 and a second end 88. First end 76 of base arm 64 and first end 86 of lifting arm 66 are pivotably connected to one another at a pivot axis 80. Lifting arm 66 is pivotable at this point of connection about pivot axis 80 in rotational directions 82, 84 relative to base arm 64.

Base arm 64 is received in a docking assembly 68. Docking assembly 68 mounts to watercraft 20 (FIG. 1) and is operable to hold base arm 64 in place. Base arm 64, as well as the remainder of motor assembly 22 are selectively removable from docking assembly 68 such that docking assembly 68 serves as a rapid means of mounting motor assembly 22 to watercraft 20. Docking assembly 68 includes a docking plate 90, a locking bracket 92 pivotably coupled to docking plate 90, and a biasing element 94 which biases locking bracket 92 into the position shown in FIG. 4. As explained below, locking bracket 92 is used to lock the remainder of motor assembly 22 into docking assembly 68. It is contemplated, however, that docking assembly 68 could be omitted entirely, with lifting mechanism 48 pivotably coupled directly to watercraft 20 instead Still referring to FIG. 4, motor 30 is also connected to lifting arm 66 at a connection joint 56. Connection joint 56 is a ball joint type joint, formed by a rounded aperture 96 formed in lifting arm 66 and a spherical member 98 mounted to shaft 38 of motor 30. Spherical member 98 is received within aperture 96 such that it may rotate therein, but is trapped by aperture 96 such that motor 30 may rotate about longitudinal axis 102 defined by shaft member 38 in rotational directions 104, 106, and such that motor 30 may tilt at an angle theta as shown. Spherical member 98 is connected about shaft 38 such that it may not move axially along axis 102 relative to shaft 38 or rotate about axis 102 relative to shaft 38. Spherical member 98 and aperture 96 thus act as a ball joint style connection between motor 30 and lifting arm 66. Alternatively, any connection joint which permits the movement of motor 30 relative to lifting arm 66 could be utilized, and as such, the illustrated embodiment of a ball joint should be taken by way of non-limiting example only.

Figure 5:
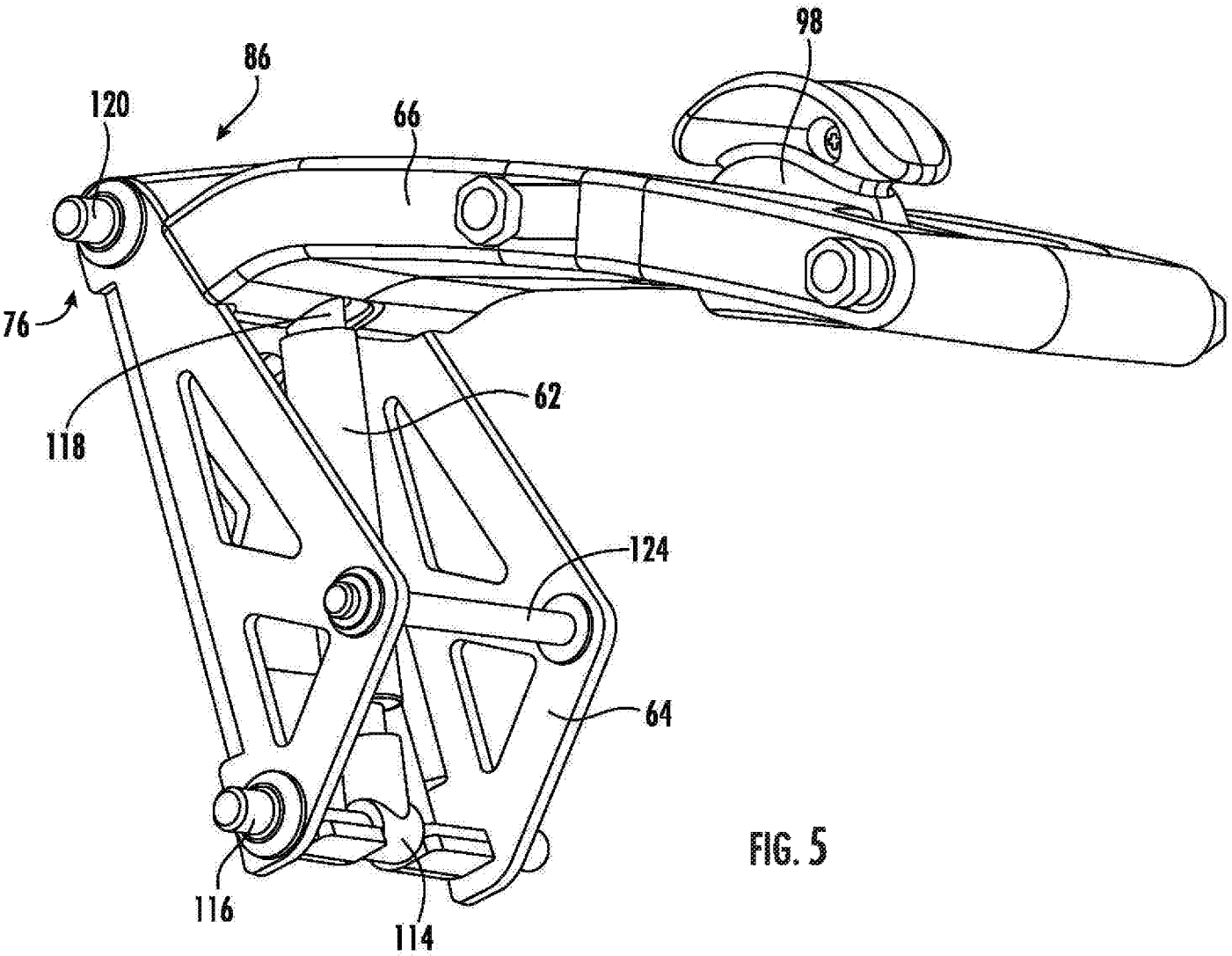
FIG. 5 is a perspective view of a portion of a lifting mechanism of the motor assembly of FIG. 4 shown in a retracted configuration.

Turning now to FIG. 5, lifting mechanism 48 is illustrated removed from docking assembly 68, with spherical member 98 held by lifting arm 66 for purposes of orientation. Lifting mechanism 48 is illustrated in its retracted configuration in this view, which places motor 30 in its deployed position (see e.g. FIG. 2). Biasing member 62 has a first end 114 connected to a lower pin 116 which extends through base arm 64 at the second end 78 thereof and defines pivot axis 70 (FIG. 4).

Biasing member 62 is connected at its second end 118 to lifting arm 66 at a point which is spaced from an upper connection pin 120 defining pivot axis 80 (FIG. 4) such that it can generate a torque upon lifting arm 66 to rotate lifting arm about pivot axis 80. As can also be seen in this view, an intermediary pin 124 is used to pivotably connect motor 30 to base arm 64 as described above. Biasing member 62 is a gas spring in the illustrated embodiment. However, biasing member 62 may be any other actuator capable of pivoting lifting arm 66 relative to base arm 64 as described herein. For non-limiting example, biasing member 62 could be embodied as one or more springs, e.g. torsion springs, connected between base arm 64 and lifting arm 66. Further, biasing member 62 could be omitted entirely in favor of a lever actuated system. In such a lever actuated system, it is contemplated that the user control described herein could include a mechanical linkage such operated by a pedal or hand control. This mechanical linkage could be used to raise motor assembly 22 from the deployed position to the stowed position using an input force provided by the user. Once in the stowed position, any mechanical expedient could be used to lock the mechanical linkage in place to thereby hold motor assembly 22 in the stowed position. Once unlocked, motor assembly can return to the deployed position under the force of gravity alone. In other words, a biasing member 62 as described herein is optional and only one way of many to provide the force necessary to transition motor assembly 22 from the stowed position to the deployed position and vice versa. As another example, a linear actuator could be utilized that directly acts upon lifting mechanism to transition the same.

Figure 6:
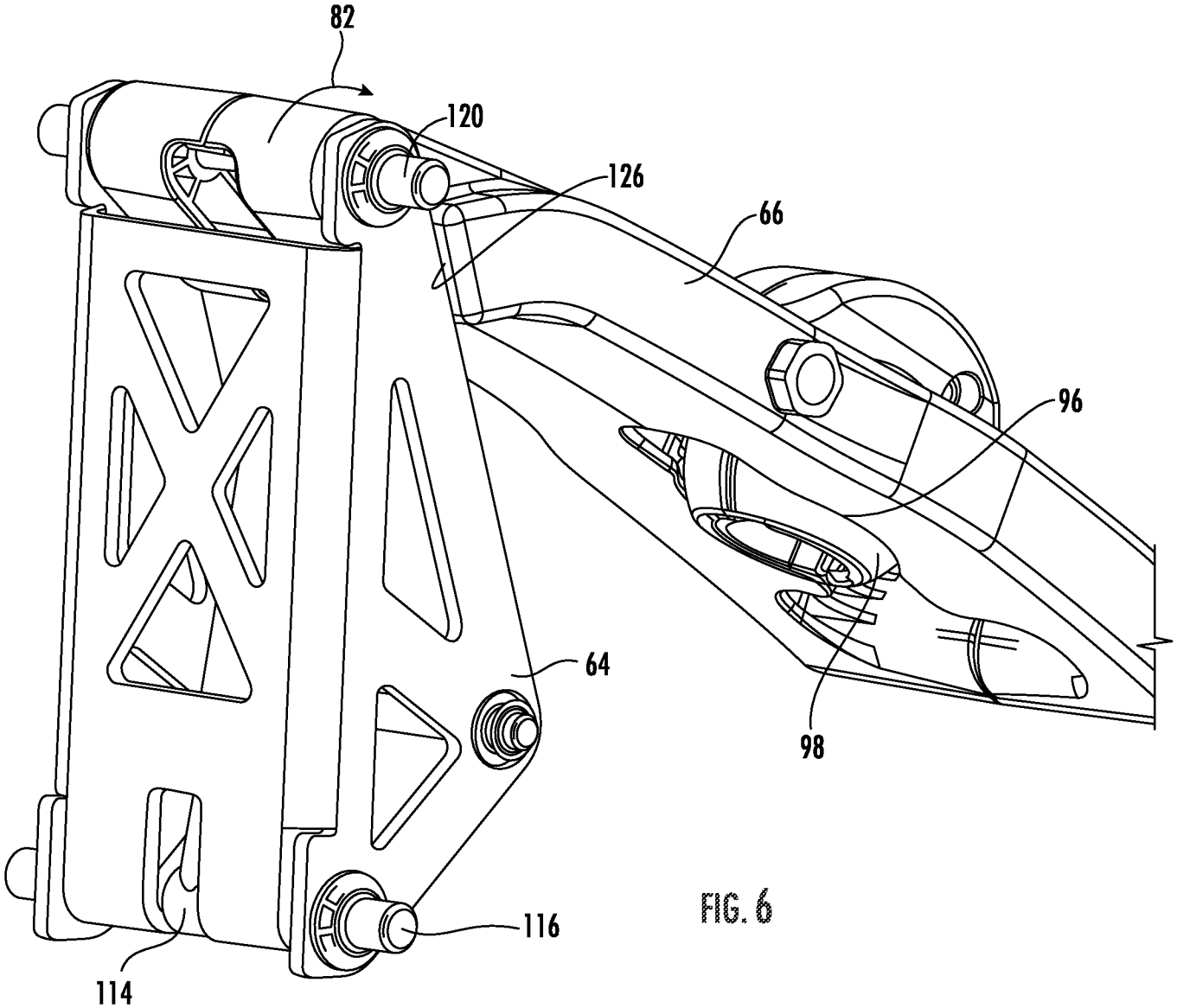
FIG. 6 is another perspective view of a portion of the lifting mechanism of FIG. 5 shown in the retracted configuration.

Turning now to FIG. 6, lifting arm 66 includes one or more outwardly projecting portions 126 which serve as positive stops to limit continued rotation of lifting arm 66 relative to base arm 64 in rotational direction 82. This configuration advantageously defines a maximum amount of travel lifting arm 66 may rotate relative to base arm 64.

Figure 7:
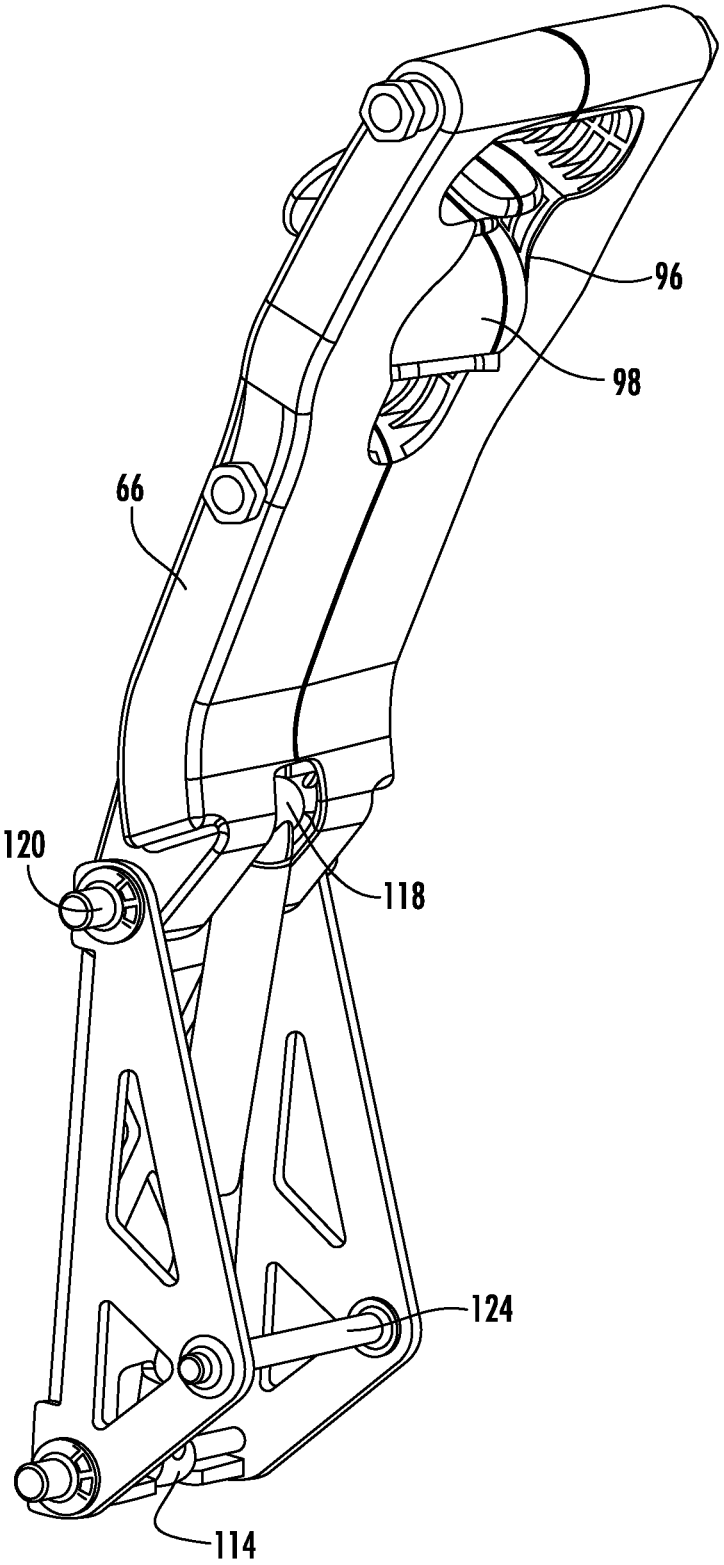
FIG. 7 is a perspective view of a portion of the lifting mechanism of FIG. 5 shown in an extended configuration.

With reference now to FIG. 7, the same illustrates the same portion of lifting mechanism shown in FIG. 6, except that the same is now in its extended position, which places motor 30 into its stowed position (see e.g. FIG. 3). As may be seen from comparison of FIG. 5 to FIG. 7, biasing member 62 has lengthened, thereby causing lifting arm 66 to rotate relative to main arm 64. As can also be seen in this view, spherical member 98 has tilted relative to base arm 64 with aperture 96. When in the retraced position as may be seen with momentary reference to FIG. 5, lifting arm 66 is at a first angle relative to base arm 64. When in the extended position as may be seen in FIG. 7, lifting arm 66 is at a second angle relative to base arm 64 which is greater than the first angle.

Figure 8:
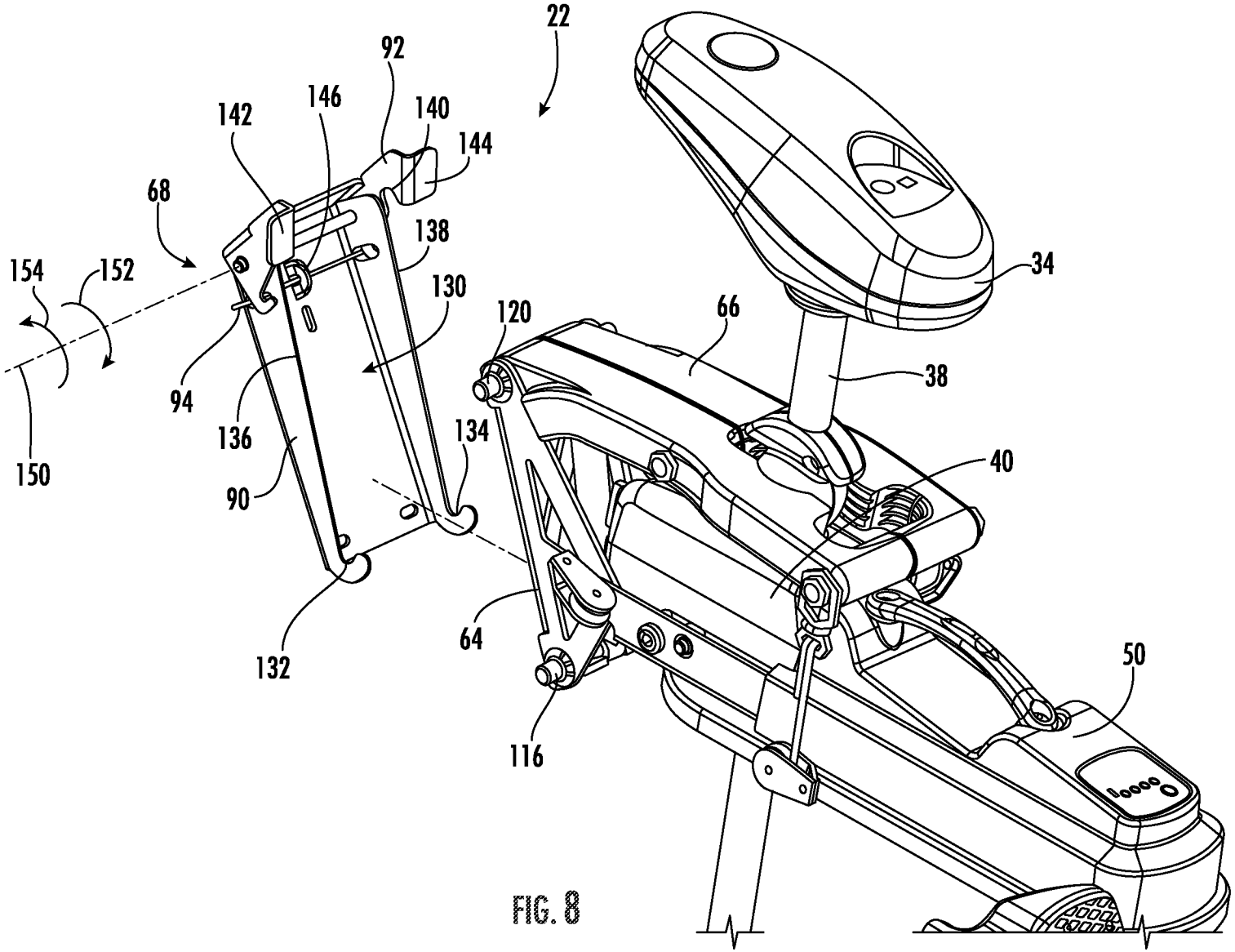
FIG. 8 is a partial perspective exploded view of the motor assembly of FIG. 4.

Turning now to FIG. 8, docking assembly 68 is shown removed from motor assembly 22. Docking assembly 68 includes a cradle region 130 configured to receive base arm 64. A pair of opposed notches 132, 134 are formed on docking plate 90 and arranged to receive corresponding ends of lower pin 116. Upper pin 120 rests upon opposed side edges 136, 138 of docking plate 90. When so rested, pin 120 is in a position such that the ends thereof are captured within opposing notches 140 formed in locking bracket 92. This locks base arm 64, and hence the remainder to motor assembly 22 relative to docking assembly 68.

Locking bracket 92 is pivotably mounted to docking plate 90 about a pivot axis 150. Biasing element 94 biases locking bracket 92 such that it rotates about pivot axis 150 in rotation direction 152 until notches 140 capture the ends of upper connection pin 120. As can be seen in FIG. 8, biasing element is held in place by a retainer 146, and functions as leaf spring. Locking bracket 92 may be rotated about axis 150 in rotational direction 154 to remove the remainder of motor assembly 22 from docking assembly 68. To rotate locking bracket 92 in direction 154, a user can depress flanges 142, 144.

Figure 9:
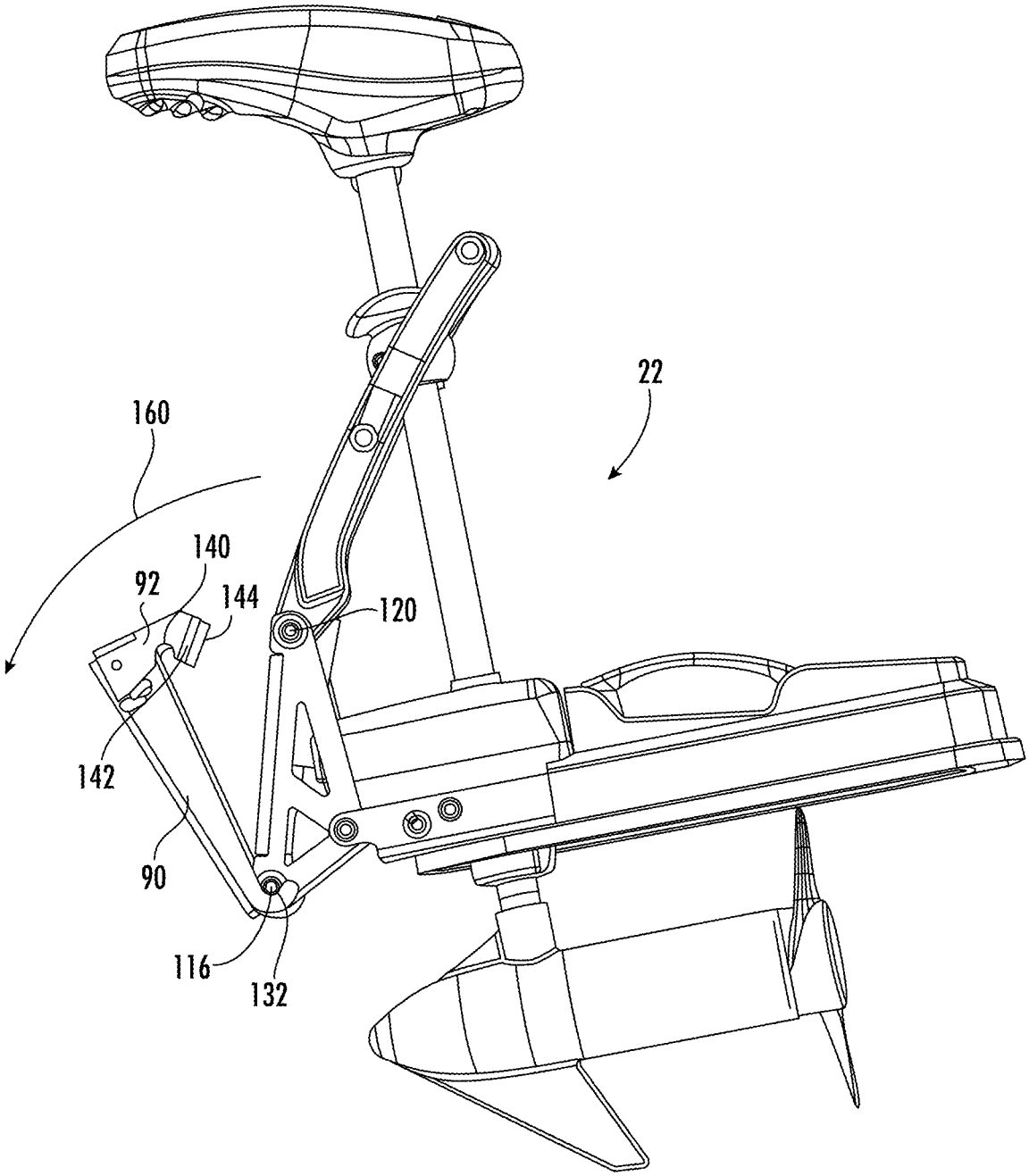
FIG. 9 is a side of the motor assembly of FIG. 4, transitioning from an undocked configuration to a docked configuration.
Figure 10:
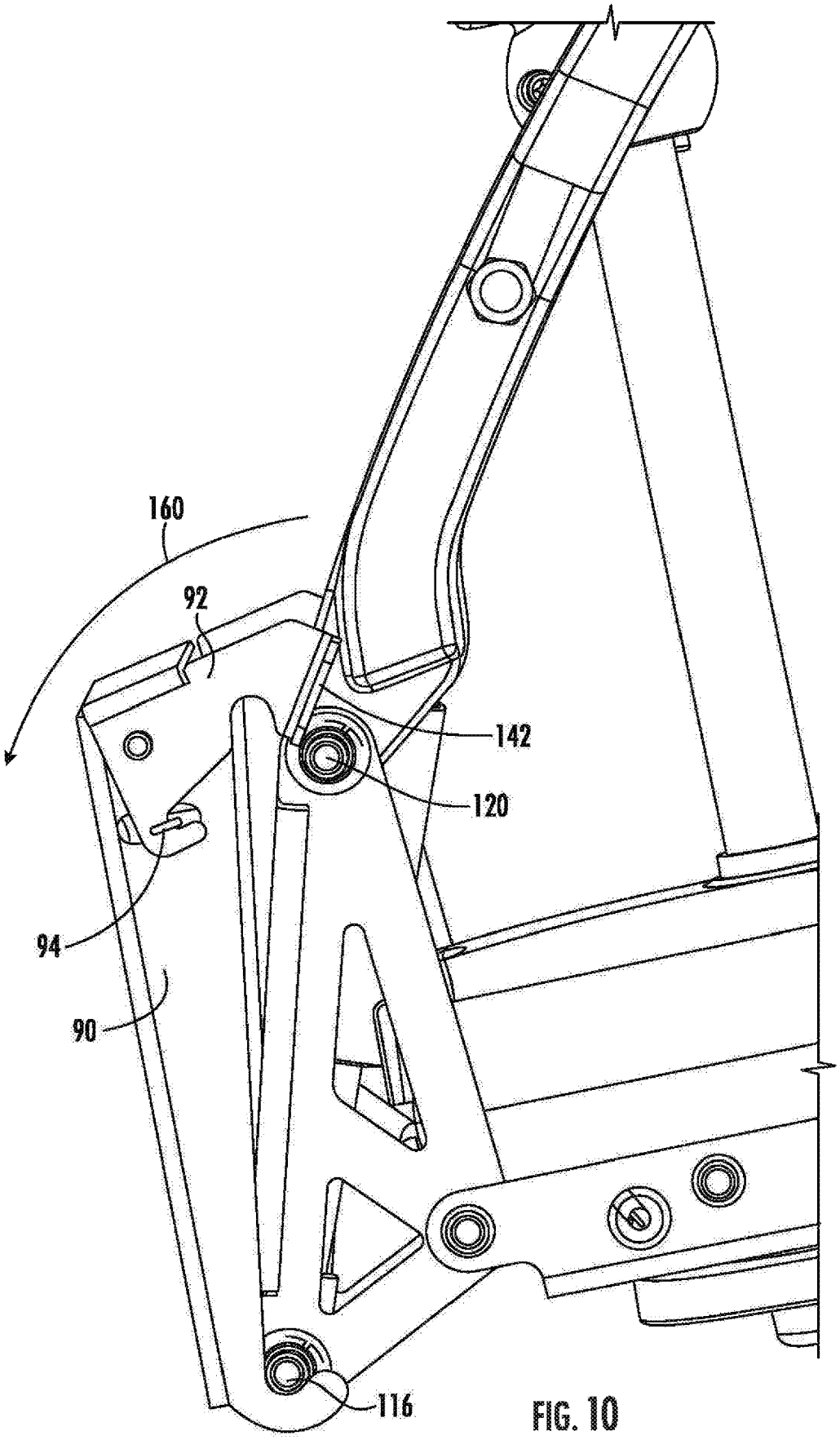
FIG. 10 is a partial side view of the motor assembly of FIG. 4 transitioning from the undocked to the docked configuration.
Figure 11:
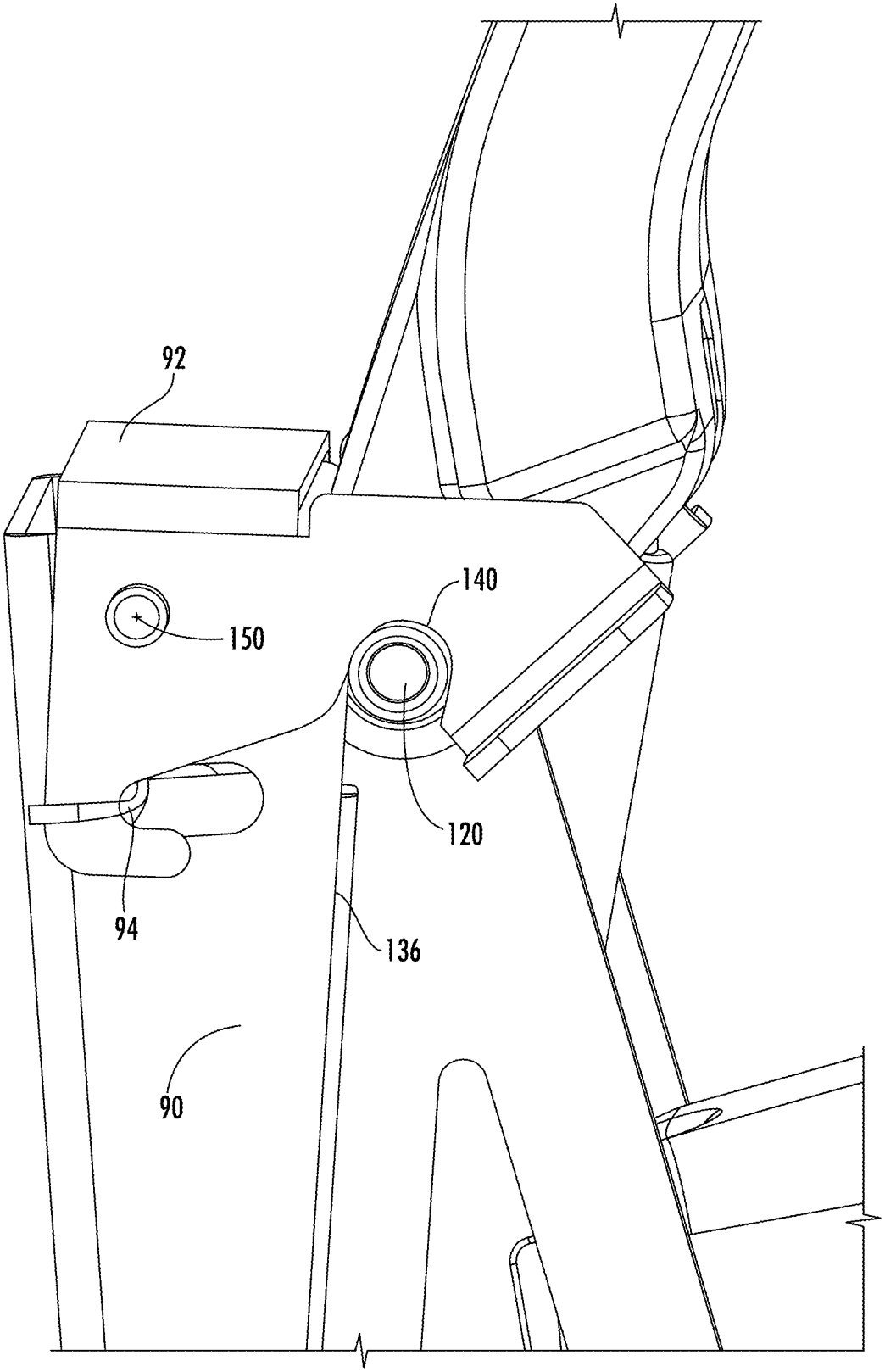
FIG. 11 is a partial side view of the motor assembly of FIG. 4 shown in the docked configuration.

Turning now to FIG. 9, once lower pin 116 is seated in notches 132, 134, and a user pivots motor assembly 22 in direction 160 as shown, upper pin 120 will contact flanges 142, 144 momentarily out of the way so that pin 120 can come to rest against edges 136, 138 (FIG. 8). Locking bracket 92 will then automatically pivot about axis 150 in direction 152 under the biasing force provided by biasing element 94 so that pin 120 is captured in notches 140. (FIG. 8). This contact of pin 120 with flanges 142, 144 is also shown in FIG. 10. FIG. 11 illustrates locking bracket 92 returning to its locked position once upper pin 120 is in its final position, such that upper pin 120 is received by notches 140.

Figure 12:
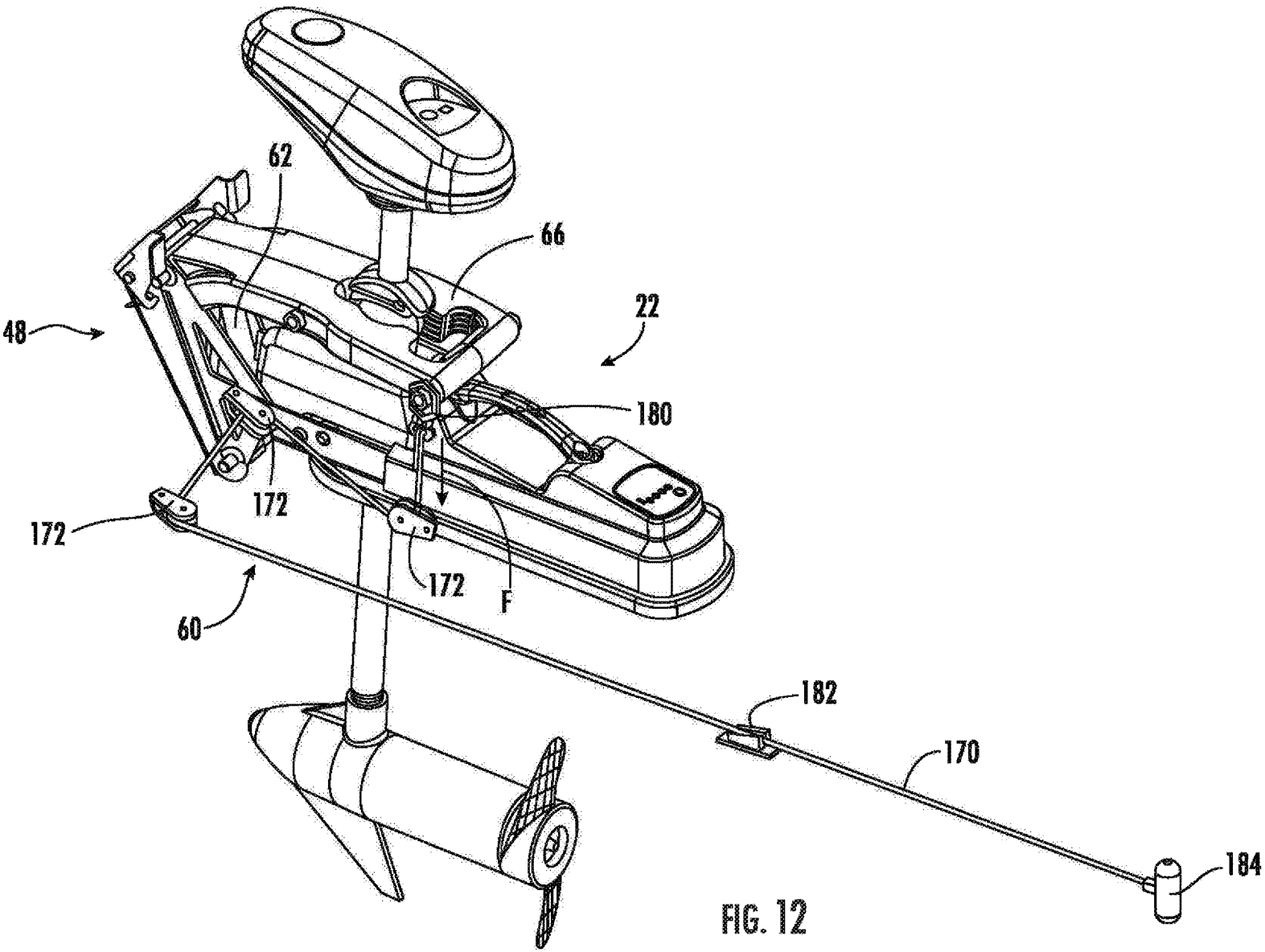
FIG. 12 is a perspective view of the motor assembly in the stowed position and associated with a user control.
Figure 13:
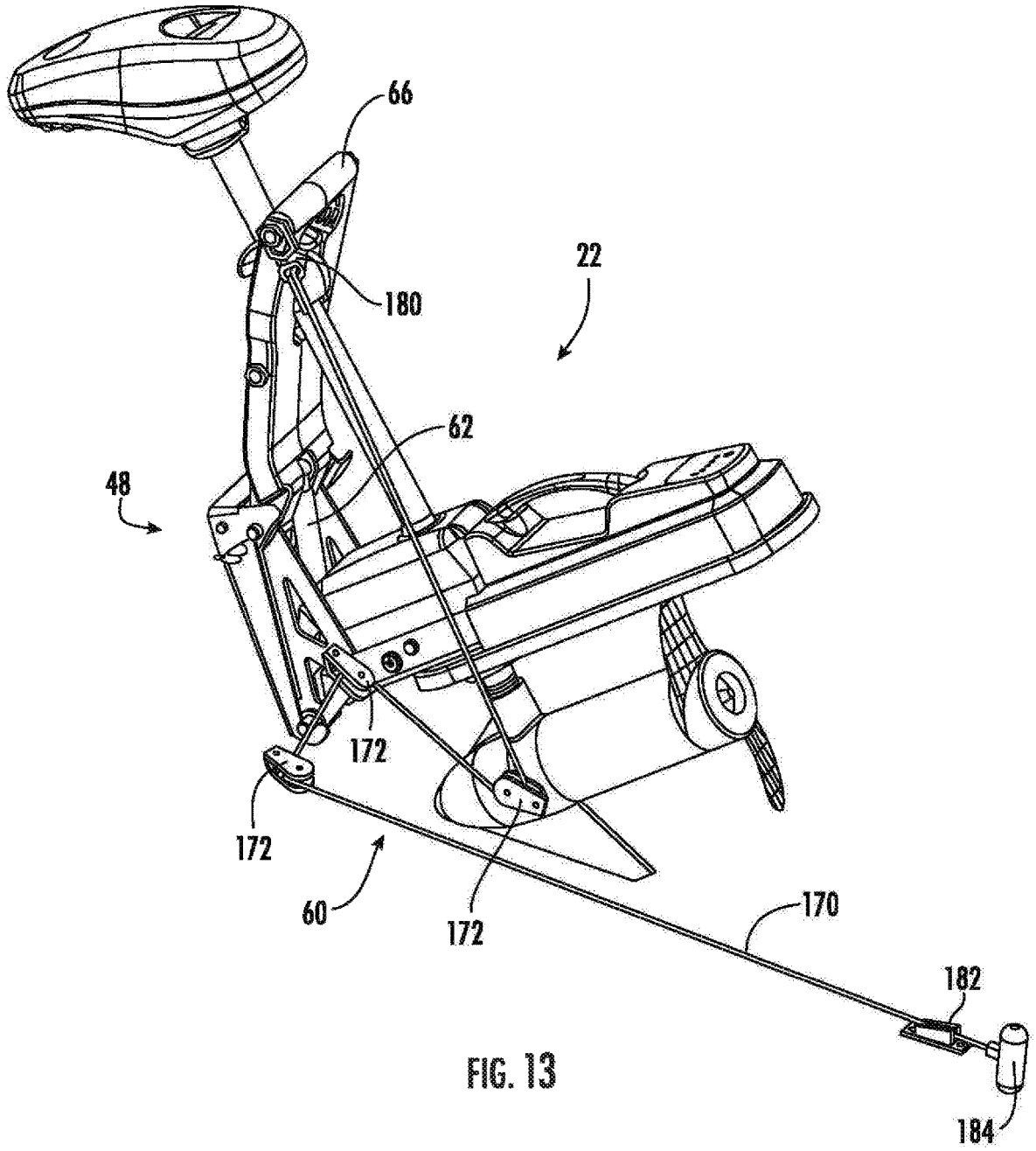
FIG. 13 is a perspective view of the motor assembly in the deployed position and associated with the user control.

Turning now to FIGS. 12-13, the above introduced user control 60 and its operation will be described in greater detail. With particular reference to FIG. 12, the remainder of watercraft 20 has been removed such that motor assembly 22 and user control 60 are visible. User control 60 includes a cable 170 routed through a series of pulleys 172. The number and orientation of pulleys is entirely dependent upon the desired cable 170 routing. Pulleys 172 mount within an internal cavity of hull 24 (FIG. 1) of watercraft 20.

A clasp 180 is attached to one end of cable 170 and connected to lifting arm 66 as shown. A handle 184 is attached at the other end of cable 170. A user can pull upon handle 184 to apply a tensile force to cable 170 which is transmitted to lifting arm 66, and creates a force F which opposes the biasing force provided by biasing member 62. Once lifting mechanism 148 is in its fully retracted configuration as is shown in FIG. 12, the user can lock cable 170 down within a locking mechanism. In the illustrated embodiment, the locking mechanism is a cleat 182 mounted on watercraft 120. This causes cable 170 to continue to exert force F so long as cleat 182 holds the same in place. Cleat 182 may be any cable cleat of the type used to hold ropes, cables, etc., or any other structure suitable to achieve such an end. Alternatively, user control 60 could be motorized such that the aforementioned locking mechanism is replaced with a motor that winds and unwinds one or more cables from a spool upon operation of a switch by a user.

Turning now to FIG. 13, to release the tension in cable 170 and thereby allow biasing member 62 to bias lifting arm 66 into the position shown in this view, cable 172 must be released from cleat 182 such that it no longer exerts force F (FIG. 12). Advantageously, handle 184 and cleat 182 are conveniently located near cockpit area 26 (FIG. 1) so that a user can transition motor 30 between its deployed and stowed position and vice versa from cockpit area 26.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A watercraft, comprising:

a hull having a passageway and defining a cockpit area;

a motor assembly situated within said passageway, the motor assembly comprising:

a motor; and a lifting mechanism operably connected to the motor for transitioning the motor from a deployed position to a stowed position and from the stowed position to the deployed position;

a user control coupled to the lifting mechanism and configured to allow a user to operate said lifting mechanism from said cockpit area; and wherein the lifting mechanism includes a biasing member, and wherein the biasing member is a gas spring.

2. The watercraft of claim 1, wherein the lifting mechanism comprises a base arm and a lifting arm, the lifting arm having a first end and a second end, wherein the first end of the lifting arm is pivotably connected to a first end of the base arm, and wherein the motor is connected to the lifting arm adjacent the second end of the lifting arm by a connection joint.

3. A watercraft, comprising:

a hull having a passageway and defining a cockpit area;

a motor assembly situated within said passageway, the motor assembly comprising:

a motor; and a lifting mechanism operably connected to the motor for transitioning the motor from a deployed position to a stowed position and from the stowed position to the deployed position; and a user control coupled to the lifting mechanism and configured to allow a user to operate said lifting mechanism from said cockpit area;

wherein the lifting mechanism includes a biasing member, and wherein the biasing member is a gas spring;

wherein the lifting mechanism comprises a base arm and a lifting arm, the lifting arm having a first end and a second end, wherein the first end of the lifting arm is pivotably connected to a first end of the base arm, and wherein the motor is connected to the lifting arm adjacent the second end of the lifting arm by a connection joint;

wherein the connection joint is a ball joint.

4. The watercraft of claim 3, wherein the ball joint comprises an aperture in the lifting arm and a spherical member connected to the motor, the spherical member rotatable within the aperture.

5. The watercraft of claim 2, wherein the gas spring has a first end and a second end, the first end of the gas spring connected to the lifting arm, the second end of the gas spring connected to the base arm such that elongation of the gas spring causes the lifting arm to rotate about a pivot axis defined by the base arm.

6. A watercraft, comprising:

a hull having a passageway and defining a cockpit area;

a motor assembly situated within said passageway, the motor assembly comprising:

a motor; and a lifting mechanism operably connected to the motor for transitioning the motor from a deployed position to a stowed position and from the stowed position to the deployed position; and a user control coupled to the lifting mechanism and configured to allow a user to operate said lifting mechanism from said cockpit area;

wherein the lifting mechanism includes a biasing member, and wherein the biasing member is a gas spring;

wherein the lifting mechanism comprises a base arm and a lifting arm, the lifting arm having a first end and a second end, wherein the first end of the lifting arm is pivotably connected to a first end of the base arm, and wherein the motor is connected to the lifting arm adjacent the second end of the lifting arm by a connection joint;

wherein the lifting mechanism further comprises a docking assembly, the docking assembly configured to mount to the hull adjacent the passageway.

7. A watercraft, comprising:

a hull having a passageway and defining a cockpit area;

a motor assembly situated within said passageway, the motor assembly comprising:

a motor; and a lifting mechanism operably connected to the motor for transitioning the motor from a deployed position to a stowed position and from the stowed position to the deployed position; and a user control coupled to the lifting mechanism and configured to allow a user to operate said lifting mechanism from said cockpit area;

wherein the lifting mechanism includes a biasing member, and wherein the biasing member is a gas spring;

wherein the lifting mechanism comprises a base arm and a lifting arm, the lifting arm having a first end and a second end, wherein the first end of the lifting arm is pivotably connected to a first end of the base arm, and wherein the motor is connected to the lifting arm adjacent the second end of the lifting arm by a connection joint;

wherein the lifting mechanism further comprises a docking assembly, the docking assembly configured to mount to the hull adjacent the passageway;

wherein the docking assembly includes a docking plate, a locking bracket, and a biasing element, the locking bracket pivotably coupled to the docking plate, the locking bracket having a locked position and an unlocked position, wherein the biasing element biases the locking bracket to the locked position.

8. The watercraft of claim 7, wherein in the locked position, a pin mounted at the first end of the base arm and defining a pivot axis of the lifting arm relative to the base arm is situated within a slot formed in the locking bracket.

9. The watercraft of claim 2, wherein the user control comprises a cable having a first end connected to the second end of the lifting arm and a second end with a handle attached to the second end, the user control further comprising a locking mechanism for locking the cable in tension such that it applies a force to oppose the biasing force to hold the motor in the deployed position.

10. A watercraft, comprising:

a hull having a passageway and defining a cockpit area;

a motor assembly situated within said passageway, the motor assembly comprising:

a motor; and a lifting mechanism operably connected to the motor for transitioning the motor from a deployed position to a stowed position and from the stowed position to the deployed position; and a user control coupled to the lifting mechanism and configured to allow a user to operate said lifting mechanism from said cockpit area;

wherein the lifting mechanism includes a biasing member, and wherein the biasing member is a gas spring;

wherein the lifting mechanism comprises a base arm and a lifting arm, the lifting arm having a first end and a second end, wherein the first end of the lifting arm is pivotably connected to a first end of the base arm, and wherein the motor is connected to the lifting arm adjacent the second end of the lifting arm by a connection joint;

wherein the user control comprises a cable having a first end connected to the second end of the lifting arm and a second end with a handle attached to the second end, the user control further comprising a locking mechanism for locking the cable in tension such that it applies a force to oppose the biasing force to hold the motor in the deployed position;

wherein the locking mechanism is a cable cleat.

11. The watercraft of claim 9, wherein the second end with the handle is situated adjacent a cockpit area of the hull.

12. A motor assembly for a watercraft, the motor assembly comprising:

a motor having a shaft having a first end and a second end, a head unit mounted at the first end, a lower unit mounted at the second end, the lower unit including a motor and a device for providing thrust; and a lifting mechanism operably connected to the motor for transitioning the motor from a deployed position to a stowed position, the lifting mechanism further comprising:

a docking assembly configured for mounting to a watercraft;

a base arm removably received within the docking assembly;

a lifting arm having a first end and a second end, wherein the first end of the lifting arm is pivotably connected to a first end of the base arm such that in a first angular position of the lifting arm relative to the base arm the motor is in the deployed position and such that in a second angular position of the lifting arm relative to the base arm, the motor is in the stowed position, wherein an angle between the lifting arm and the base arm in the first angular position is less than an angle of the lifting arm relative to the base arm in the second angular position; and a biasing member connected between the lifting arm and the base arm for biasing the motor to the stowed position.

13. The motor assembly of claim 12, wherein the docking assembly includes a docking plate, a locking bracket, and a biasing element, the locking bracket pivotably coupled to the docking plate, the locking bracket having a locked position and an unlocked position, wherein the biasing element biases the locking bracket to the locked position.

14. The motor assembly of claim 12, wherein in the locked position, a pin mounted at the first end of the base arm and defining a pivot axis of the lifting arm relative to the base arm is situated within a slot formed in the locking bracket.

15. A lifting mechanism for a motor, the lifting mechanism configured for transitioning the motor from a deployed position to a stowed position, the motor having a shaft having a first end and a second end, a head unit mounted at the first end, a lower unit mounted at the second end, the lower unit including a motor and a device for providing thrust, the lifting mechanism comprising:

a docking assembly configured for mounting to a watercraft;

a base arm removably received within the locking bracket;

a lifting arm having a first end and a second end, wherein the first end of the lifting arm is pivotably connected to a first end of the base arm and wherein a second end of the lifting arm is configured for connecting to a motor via a connection joint, wherein the first end of the lifting arm and the first end of the base arm are commonly connected at a pin defining a pivot axis of the lifting arm relative to the base arm;

a biasing member connected between the lifting arm and the base arm for biasing the motor to the stowed position;

wherein the docking assembly is configured to receive the base arm and lock the base arm into a cradle defined by the docking assembly as the base arm is rotated about a mounting axis defined by the docking assembly.

16. The lifting assembly of claim 15, wherein the docking assembly includes a docking plate, a locking bracket, and a biasing element, the locking bracket pivotably coupled to the docking plate, the locking bracket having a locked position and an unlocked position, wherein the biasing element biases the locking bracket to the locked position such that the pin is constrained within a slot formed in the locking bracket.

17. The lifting mechanism of claim 16, wherein the locking bracket includes at least one strike plate, the at least one strike plate arranged such that the pin contacts the strike plate when rotating the base arm about the mounting axis and biases the locking bracket to the unlocked position.

18. The lifting mechanism of claim 17, wherein the pin biases the locking plate to the unlocked position such that the pin rests upon the docking plate.

19. The lifting mechanism of claim 18, wherein the biasing element is a leaf spring.

* * * * *